US007949273B2

(12) United States Patent
Otsuka

(10) Patent No.: US 7,949,273 B2
(45) Date of Patent: May 24, 2011

(54) FIXING DEVICE, FIXING DEVICE TEMPERATURE CONTROL METHOD AND IMAGE FORMING APPARATUS

(75) Inventor: Yutaka Otsuka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 933 days.

(21) Appl. No.: 11/776,588

(22) Filed: Jul. 12, 2007

(65) Prior Publication Data

US 2008/0069581 A1 Mar. 20, 2008

(30) Foreign Application Priority Data

Sep. 20, 2006 (JP) ..... 2006-254387

(51) Int. Cl.
*G03G 15/20* (2006.01)

(52) U.S. Cl. ..... 399/69

(58) Field of Classification Search ..... 399/67, 399/69, 70

See application file for complete search history.

(56) References Cited

U.S. PATENT DOCUMENTS

| | | | |
|---|---|---|---|
| 6,367,972 | B1 | 4/2002 | Kamiyama et al. |
| 6,964,515 | B2 | 11/2005 | Asakura et al. |

FOREIGN PATENT DOCUMENTS

| | | | |
|---|---|---|---|
| JP | 5-217660 | A | 8/1993 |
| JP | 07-160143 | | 6/1995 |
| JP | 9-190109 | A | 7/1997 |
| JP | 11-223555 | A | 8/1999 |
| JP | 2000-039800 | A | 2/2000 |
| JP | 2001-109318 | | 4/2001 |
| JP | 2002-251099 | A | 9/2002 |
| JP | 2003-263066 | A | 9/2003 |
| JP | 2004-191075 | A | 7/2004 |
| JP | 2004-246045 | A | 9/2004 |
| JP | 2005-024436 | A | 1/2005 |
| JP | 2005-300915 | | 10/2005 |
| JP | 2005-315990 | A | 11/2005 |

OTHER PUBLICATIONS

Machine Translation of JP 2005-300915 A.*
Preliminary Notice of Rejection in JP 2006-254387 dated Aug. 12, 2008, with English Translation thereof.

* cited by examiner

*Primary Examiner* — David M Gray
*Assistant Examiner* — Gregory H Curran
(74) *Attorney, Agent, or Firm* — Buchanan Ingersoll & Rooney PC

(57) ABSTRACT

A fixing device has a heating roller and a pressurizing belt which convey the a recording material in mutual contact while fixing a toner on the recording material, a heater which heats the heating roller, a noncontact first thermister which detects a surface temperature of the heating roller in a position located apart from a surface of the heating roller, a pressurizing unit which is placed inside the pressurizing belt, a second thermister which detects a temperature of the pressurizing unit; and a control section which adjusts the surface temperature of the heating roller by controlling the heater on the basis of a detection temperature of the first thermister and a detection temperature of the second thermister. Thus, fixing device is capable of suppressing a temperature difference generated in noncontact temperature detecting sections and obtaining a stable fixed image performance.

15 Claims, 10 Drawing Sheets

FIXING DEVICE, FIXING DEVICE TEMPERATURE CONTROL METHOD AND IMAGE FORMING APPARATUS

CROSS-REFERENCE TO RELATED APPLICATIONS

This application is based on application No. 2006-254387 filed in Japan, the entire content of which is hereby incorporated by reference.

BACKGROUND OF THE INVENTION

The present invention relates to a fixing device for use in, for example, a copying machine, a laser beam printer or a facsimile. The present invention also relates to a temperature control method for the fixing device, and an image forming apparatus that employs the fixing device.

In a conventional fixing device, a noncontact temperature sensor has detected a surface temperature of a heating and fixing roller in a position located apart from the surface of the heating and fixing roller (refer to JP 11-223555 A).

In the conventional fixing device, therefore, the noncontact temperature sensor has belatedly detected the surface temperature of the heating and fixing roller. This has caused a problem that the surface temperature of the heating and fixing roller and the detection temperature of the noncontact temperature sensor differ from each other. Accordingly, it has been difficult to stably adjust the temperature of the heating and fixing roller on the basis of the detection temperature of the noncontact temperature sensor. Therefore, the fixed image performance has not been stable.

The noncontact temperature sensor also detects the temperature of the atmosphere in the neighborhood of the noncontact temperature sensor. Therefore, the detected temperature varies depending on the sensor placement distance from the heating and fixing roller, variation of the environmental temperature, the warming degree of the fixing device or the like. As the result, it has been difficult to stably adjust the temperature of the heating and fixing roller with use of only the temperature detected by the noncontact temperature sensor, since those temperature variations cannot be correctly predicted.

BRIEF SUMMARY OF THE INVENTION

An object of the present invention is to provide a fixing device capable of suppressing a temperature difference generated in noncontact temperature detecting sections, obtaining a stable fixed image performance, correctly determining the detection temperature fluctuation in the temperature detecting sections depending on the environment and stably adjusting the temperature of the heating and fixing roller, and to provide an image forming apparatus that employs the fixing device. Also, another object of the present invention is to provide a temperature control method for the fixing device.

In order to achieve the above-mentioned object, a first aspect of the present invention provides a fixing device comprising:

- a heating rotation unit and a pressurizing rotation unit which convey a recording material in mutual contact while fixing a toner on the recording material;
- a heating section which heats the heating rotation unit;
- a noncontact first temperature detecting section which detects a surface temperature of the heating rotation unit in a position located apart from a surface of the heating rotation unit;

- a pressurizing unit which is placed inside the pressurizing rotation unit and pressurizes the pressurizing rotation unit against the heating rotation unit from inside the pressurizing rotation unit;
- a second temperature detecting section which detects a temperature of the pressurizing unit; and
- a control section which adjusts the surface temperature of the heating rotation unit by controlling the heating section on the basis of a detection temperature of the first temperature detecting section and a detection temperature of the second temperature detecting section.

According to the fixing device of the present invention, the second temperature detecting section is provided for detecting the temperature of the pressurizing unit placed inside the pressurizing rotation unit, and therefore, the second temperature detecting section can correctly measure the warming degree of the heating rotation unit and the pressurizing rotation unit. This is because the pressurizing unit is placed inside the pressurizing rotation unit, so that no sharp temperature change is caused by the rotation and the pressurizing unit is hard to cool.

The control section adjusts the surface temperature of the heating rotation unit by controlling the heating section on the basis of both the detection temperature of the first temperature detecting section and the detection temperature of the second temperature detecting section. Therefore, it is possible to obtain a stable temperature detection performance because the temperature difference between the surface temperature of the heating rotation unit and the detection temperature of the first temperature detecting section is corrected by the detection temperature of the second temperature detecting section which can measure the warming degree of the heating rotation unit and the pressurizing rotation unit. Also, even if the detection temperature of the first temperature detecting section is varied by the placement distance of the first temperature detecting section to the heating rotation unit, the environmental variation, the warming degree of the fixing device and the like, the variation in the detection temperature of the first temperature detecting section can correctly be determined by the detection temperature of the second temperature detecting section. Thus, the surface temperature of the heating rotation unit can stably be adjusted.

Thus, it is possible to suppress the temperature difference generated in the noncontact first temperature detecting section, and therefore to obtain a stable fixed image performance. Also, the detection temperature fluctuation in the first temperature detecting section, due to the environment and so on, is correctly determined, and therefore the surface temperature of the heating rotation unit can stably be adjusted.

A second aspect of the present invention provides a fixing device temperature control method comprising the steps of:

- detecting a surface temperature of a heating rotation unit in a position located apart from a surface of the heating rotation unit by using a noncontact first temperature detecting section;
- detecting a temperature of a pressurizing unit, which is placed inside a pressurizing rotation unit and pressurizes the pressurizing rotation unit against the heating rotation unit from inside of the pressurizing rotation unit, by using a second temperature detecting section; and
- adjusting a surface temperature of the heating rotation unit by controlling a heating section which heats the heating rotation unit with use of a control section on the basis of a detection temperature of the first temperature detecting section and a detection temperature of the second temperature detecting section.

According to the fixing device temperature control method of the present invention, operational advantages identical to those of the above-stated fixing device are obtained.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail below by embodiments with reference to the attached drawings.

First Embodiment

Figure 1:
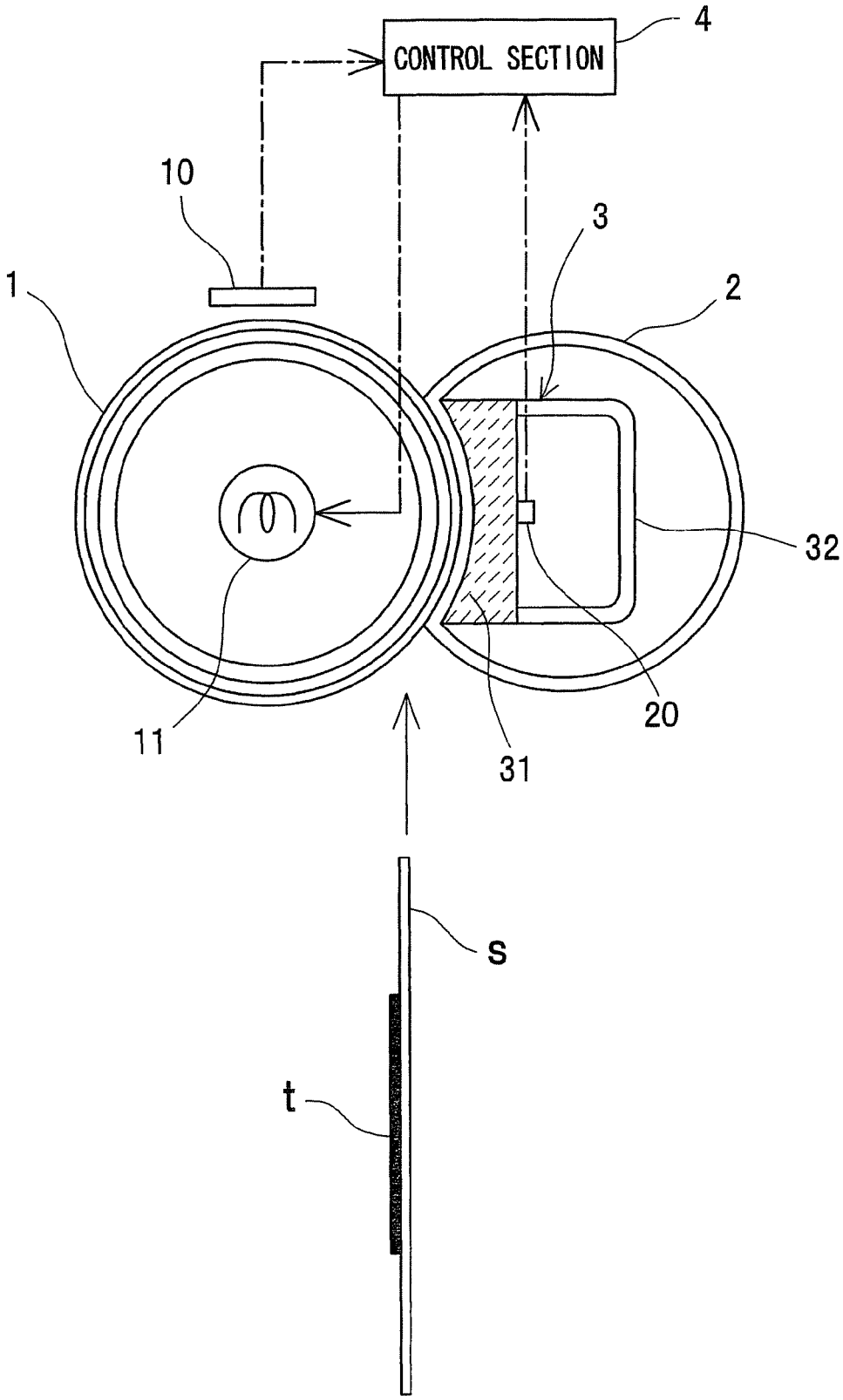
FIG. 1 is a schematic structural view showing a first embodiment of a fixing device of the present invention.

FIG. 1 shows a schematic structural view of a fixing device in a first embodiment of the present invention. The fixing device has a heating roller 1 as a heating rotation unit, and a pressure belt 2 as a pressurizing rotation unit. The heating roller 1 is heated by a heater 11 as a heating section.

The heating roller 1 and the pressure belt 2 contact each other to fix a toner t on a recording material S while conveying the recording material S. Specifically, a nip portion is formed by contacting the heating roller 1 with the pressure belt 2, and the nip portion fuses and fixes the toner t on the recording material S while conveying the recording material S.

The recording material S is, for example, a sheet of a paper, an OHP sheet or the like. The toner t adheres to one surface of the recording material S. The toner t is made of a material having a thermo-fusibility such as a resin, a magnetic material or a colorant.

The heating roller 1 is a fixing roller which comes in contact with one surface (i.e. image surface) of the recording material S. The heating roller 1 is a hollow roller. The heating roller 1 has a core layer, an elastic layer and a surface layer which are arranged in order from inside to outside. The heating roller 1 has an outside diameter of 26 mm for example. The core layer is made of aluminum having a thickness of 2 mm for example. The elastic layer is made of silicone rubber having a thickness of 200 μm for example. The surface layer is made of a PFA tube having a thickness of 20 μm for example.

The pressure belt 2 is an endless belt. The pressure belt 2 has an outside diameter of 30 mm for example and is made of polyimide having a thickness of 70 μm for example.

A pressurizing unit 3 is placed inside the pressure belt 2 so as to pressurize the pressure belt 2 against the heating roller 1 from inside of the pressure belt 2.

The pressurizing unit 3 has a pad portion 31 that comes in contact with the pressure belt 2 and a reinforcing portion 32 that supports the pad portion 31.

The pad portion 31 has a small coefficient of friction in its contact surface brought in contact with the pressure belt 2 and is made of a resin for example. Specifically, the pad portion 31 is made of a heat-resisting resin PPS and has a thermal conductivity of about 0.2 W/m·K. It is noted that the material of the pad portion 31 is not limited to the heat-resisting resin. The pad portion 31 may also be made of a metallic material such as aluminum or iron, a ceramics material such as alumina or an elastic material such as silicone rubber. The reinforcing portion 32 is made of stainless steel for example.

The pad portion 31 contacts with the heating roller 1 via the pressure belt 2 to form the nip portion. The outer surface of the pad portion 31 has a concave shape, where the nip portion is formed. The pad portion 31 has, for example, a thickness of 4 mm and a width of 12 mm in the direction of rotation of the heating roller 1. The radius of curvature of the outer surface of the concave shape is 15.4 mm.

The heating roller 1 is rotated by an unshown drive section where a motor or the like is provided. The pressure belt 2 is driven to rotate by a friction with the heating roller 1 in accordance with the rotation of the heating roller 1.

The pressure belt 2 is pressurized against the heating roller 1 with a load of 100 to 530 N by the pressurizing unit 3. In this case, the width dimension (dimension in the direction of rotation of the pressure belt 2) of the nip portion is about 9 mm. The length dimension (dimension in the direction of rotation axis of the pressure belt 2) of the nip portion is about 240 mm. Change in the load may change the width dimension and/or the length dimension of the nip portion.

The heater 11 placed inside the heating roller 1 heats the heating roller 1 from inside. The heater 11 raises the temperatures of the heating roller 1 and the pressure belt 2 up to a temperature at which the toner t on the recording material S can be fixed.

A heating thermistor 10 as a first temperature detecting section is provided outside the heating roller 1. The heating thermistor 10 located apart from the surface of the heating roller 1 detects the surface temperature of the heating roller 1.

In this case, since the heating thermistor 10 is a noncontact sensor, the surface of the heating roller 1 is not damaged. Therefore, the durability of the heating roller 1 can be improved and image noises can be prevented.

A pressure thermistor 20 as a second temperature detecting section is attached to a surface of the pad portion 31. The pressure thermistor 20 detects the temperature of the pad portion 31.

The heater 11 is controlled to have a prescribed temperature by a control section 4 on the basis of the detection temperature of the heating thermistor 10 and the detection temperature of the pressure thermistor 20.

That is, the control section 4 adjusts the surface temperature of the heating roller 1 by controlling the heater 11 on the basis of the detection temperature of the heating thermistor 10 and the detection temperature of the pressure thermistor 20.

The fixing device is provided with the pressure thermistor 20 for detecting the temperature of the pressurizing unit 3 placed inside the pressure belt 2. The pressurizing unit 3 is located between the pressure belt 2 and the pressure thermistor 20 therein and difficult to be cooled because the temperature of the pressurizing unit 3 does not sharply change by rotation of the belt. Therefore, the pressure thermistor 20 can correctly measure a warming degree of the heating roller 1 and the pressure belt 2.

Then, the control section 4 controls the heater 11 on the basis of the detection temperatures of the heating thermistor 10 and the pressure thermistor 20. Therefore, a stable performance of temperature detection can be obtained by correcting the temperature difference between the surface temperature of the heating roller 1 and the detection temperature of the heating thermistor 10 by using the detection temperature of the pressure thermistor 20 which can measure the warming degree of the heating roller 1 and the pressure belt 2. Thus, the variation in the detection temperature of the heating thermistor 10 can correctly be determined by the detection temperature of the pressure thermistor 20 even if the detection temperature of the heating thermistor 10 is varied by the placement distance of the heating thermistor 10 to the heating roller 1, the environmental variation, the warming degree of the fixing device and the like. Therefore, the surface temperature of the heating roller 1 can stably be adjusted.

Therefore, the temperature difference in the noncontact heating thermistor 10 can be suppressed, and a stable fixed image performance can be obtained, so that the surface temperature of the heating roller 1 can stably be adjusted by correctly determining the detection temperature fluctuation of the heating thermistor 10 due to the environment and so on.

More specifically, since the heating thermistor 10 is placed in a noncontact manner with respect to the heating roller 1, heat from the heating roller 1 is transferred to the heating thermistor 10 by heat convection and radiation.

Accordingly, the heating roller 1 is controlled with temperature adjustment by using a corrected temperature which is obtained by multiplying the detection temperature of the noncontact heating thermistor 10 by a correction factor, for example. The correction factor is preparatorily set according to the response performance and the placement distance of the noncontact heating thermistor 10 and peripheral structures.

Moreover, the correction factor needs to be changed even when the fixing device is cooled down or warmed up. However, the correction factor cannot be preparatorily determined.

The pressurizing unit 3, which is located inside the pressure belt 2, is hard to become cool because the temperature of the pressurizing unit 3 is not sharply changed by rotation of the belt. The warming degree of the heating roller 1 and the pressure belt 2 can correctly be measured by measuring the temperature of the pressurizing unit 3 with use of the pressure thermistor 20.

In short, the temperature of the pressurizing unit 3, which indicates the warming degree of the heating roller 1 and the pressure belt 2, is used for the correction of the heating thermistor 10. Then, the correction factor is changed by the temperature of the pressurizing unit 3.

That is, the control section 4 adjusts the surface temperature of the heating roller 1 by controlling the heater 11 on the basis of an optimal correction factor and the detection temperature of the heating thermistor 10 after making the control section 4 obtain the optimal correction factor on the basis of the detection temperature of the pressure thermistor 20. Therefore, it is possible to more stably adjust the surface temperature of the heating roller 1 by more correctly catching the detection temperature fluctuation of the heating thermistor 10 due to the environment and so on.

Moreover, the pressure thermistor 20 can easily be attached to the pad portion 31 since the pressure thermistor 20 is attached to the surface of the pad portion 31 (the pressurizing unit 3).

Moreover, since no heating section for heating the pressure belt 2 is provided inside the pressure belt 2, the pressure thermistor 20 can correctly measure the warming degree of the heating roller 1 and the pressure belt 2 without being influenced by the heating section for heating the pressure belt 2.

Moreover, the heating roller 1 is a hollow roller and the pressure belt 2 is an endless belt, and thereby the fixing device is suitable for placing the heater 11 and the pressurizing unit 3.

Operations of the fixing device will be described next with reference to FIG. 1.

First of all, temperature adjustments of the fixing device are conducted. That is, this operation (hereinafter referred to as warm-up) is to raise the surface temperatures of the heating roller 1 and the pressure belt 2 to a fixable temperature.

In this case, the warm-up is carried out immediately after turning on the power of the device, at the time of recovery from jam processing, at the time of opening the cover of the device or at the time of recovery from a sleep mode.

The heater 11 is turned on to raise the surface temperature of the heating roller 1. Heat of the heating roller 1 is transferred to the surface of the pressure belt 2 while the pressure belt 2 is driven to rotate by rotating the heating roller 1.

As described above, the heater 11 is turned on while rotating the heating roller 1 and the pressure belt 2, so that the surface of the heating roller 1 and the surface of the pressure belt 2 can be raised in a shorter time to a temperature at which the fixing can be achieved.

In this case, assuming that the detection temperature by the heating thermistor 10 is T, a correction factor is R and a temperature after the correction is T', then the relation: $T'=R\times T$ is satisfied. Then, the corrected temperature T' is used for control relevant to temperature adjustment.

A "ready" flag, which represents that fixing can be achieved, is set when the corrected temperature T' of the heating thermistor 10 reaches the prescribed temperature. Specifically, the "ready" flag is set when the corrected temperature T' is 190° C. for example.

In the absence of a printing signal, printing goes into an awaiting state. In the presence of the printing signal, on the other hand, printing operation is started. Herein, the printing is defined as printing by the printer when the present fixing device is used for a printer.

In the awaiting state, the rotations of the heating roller 1 and the pressure belt 2 are normally stopped, and the heater 11 is controlled so that the heater 11 comes to have a prescribed setting temperature. The setting temperature of the heater 11 is 190° C. for example, and the heater 11 is controlled to be turned on or off by using the corrected temperature T' as an input.

During printing, the temperature of the pressure belt 2 is raised by transferring the heat of the heating roller 1 to the pressure belt 2, which is performed by rotating the heating roller 1 and the pressure belt 2 before the recording material S enters the fixing device from the start of printing.

Subsequently, the toner t on the recording material S is fixed by using the fixing device. The recording material S is sent into the nip portion where the heating roller 1 is contacted with the pressure belt 2. Unfixed toner t adheres to one surface of the recording material S.

The unfixed toner t is fused and fixed by heating and pressurizing the one surface of the recording material S at the nip portion. At the same time, the recording material S is conveyed with use of a conveyance force to one surface of the recording material S given by rotating the heating roller 1. At this time, the pressure belt 2 is driven to rotate in accordance with the conveyance of the recording material S.

The pressurizing unit 3 (the pad portion 31) receives heat from the heating roller 1 via the pressure belt 2. Although the surface temperatures of the heating roller 1 and the pressure belt 2 are influenced by passage of the recording material S, some experiments indicate that the temperature of the pressurizing unit 3 is little influenced.

The detection temperature of the pressure thermistor 20 does not extremely change in a state of sheet passing, and therefore the degree of warming can stably be measured. A higher stability can be obtained than when using the surface temperature at the end portion of the heating roller 1 or the surface temperature of the pressure belt 2.

The correction factor R, which is used for the correction control of the detection temperature of the heating thermistor 10, varies its ideal value depending on the warming degree of the heating roller 1 and the pressure belt 2. The temperature of the pressurizing unit 3 (the pad portion 31) that represents the warming degree of the heating roller 1 and the pressure belt 2 is used in order to set the ideal value of the correction factor R. That is, the value of the correction factor R is varied on the basis of the detection temperature of the pressure thermistor 20.

For example, the relation between the detection temperature of the pressure thermistor 20 and the correction factor R is shown in the following Table 1.

TABLE 1

| Detection Temperature [° C.] of Pressure Thermistor | Correction Factor R |
|---|---|
| 20-30 | 1.6 |
| 30-50 | 1.5 |
| 50-70 | 1.4 |
| 70-90 | 1.3 |
| 90-110 | 1.2 |

In short, the method of controlling the fixing device has the step of detecting the surface temperature of the heating roller 1 by using the heating thermistor 10, the step of detecting the temperature of the pressurizing unit 3 by using the pressure thermistor 20, and the step of controlling by adjusting the surface temperature of the heating roller 1 wherein the heater 11 is controlled by the control section 4 on the basis of the detection temperature of the heating thermistor 10 and the detection temperature of the pressure thermistor 20.

The temperature of the pressurizing unit 3 is detected by the pressure thermistor 20, and therefore the warming degree of the heating roller 1 and the pressure belt 2 can correctly be measured. The temperature of the heater 11 is controlled by the control section 4 on the basis of the detection temperature of the heating thermistor 10 and the detection temperature of the pressure thermistor 20. Thus, the temperature difference between the surface temperature of the heating roller 1 and the detection temperature of the heating thermistor 10 is corrected by the detection temperature of the pressure thermistor 20 which can measure the warming degree of the heating roller 1 and the pressure belt 2, so that a stable temperature detection performance can be obtained. As described above, it is possible to suppress the temperature difference generated in the heating thermistor 10 and therefore to obtain a stable fixed image performance. Moreover, the variation in the detection temperature of the heating thermistor 10 can be correctly determined by using the detection temperature of the pressure thermistor 20 even if the detection temperature of the heating thermistor 10 is varied by the placement distance of the heating thermistor 10 to the heating roller 1, the environmental variation, the warming degree of the fixing device and the like. Therefore, the surface temperature of the heating roller 1 can stably be adjusted.

Moreover, the control section 4 obtains the optimal correction factor on the basis of the detection temperature of the pressure thermistor 20 and controls the heater 11 on the basis of the correction factor and the detection temperature of the heating thermistor 10. Therefore, the surface temperature of the heating roller 1 can be adjusted more stably by more correctly determining the detection temperature fluctuation of the heating thermistor 10 due to the environment and so on.

The temperature of the heater 11 is controlled by the control section 4 where at least the detection temperature of the heating thermistor 10 and the detection temperature of the pressure thermistor 20 are inputted and the amount of power supply to the heater 11 is outputted. Thereby, the temperature of the heater 11 is stably controlled.

More specifically, the temperature of the heater 11 is controlled by the control section 4 where a corrected temperature T' is used as an input. The corrected temperature T' is made by multiplying the detection temperature of the heating thermistor 10 by an optimal correction factor R obtained on the basis of the detection temperature of the pressure thermistor 20. Therefore, the temperature of the heater 11 is stably controlled.

As an input for changing the value of the correction factor R, it is acceptable to use, for example, a temperature obtained by an environmental temperature sensor (not shown) or to use the endurable number of sheets in addition to the detection temperature of the pressure thermistor 20.

Second Embodiment

Figure 2:
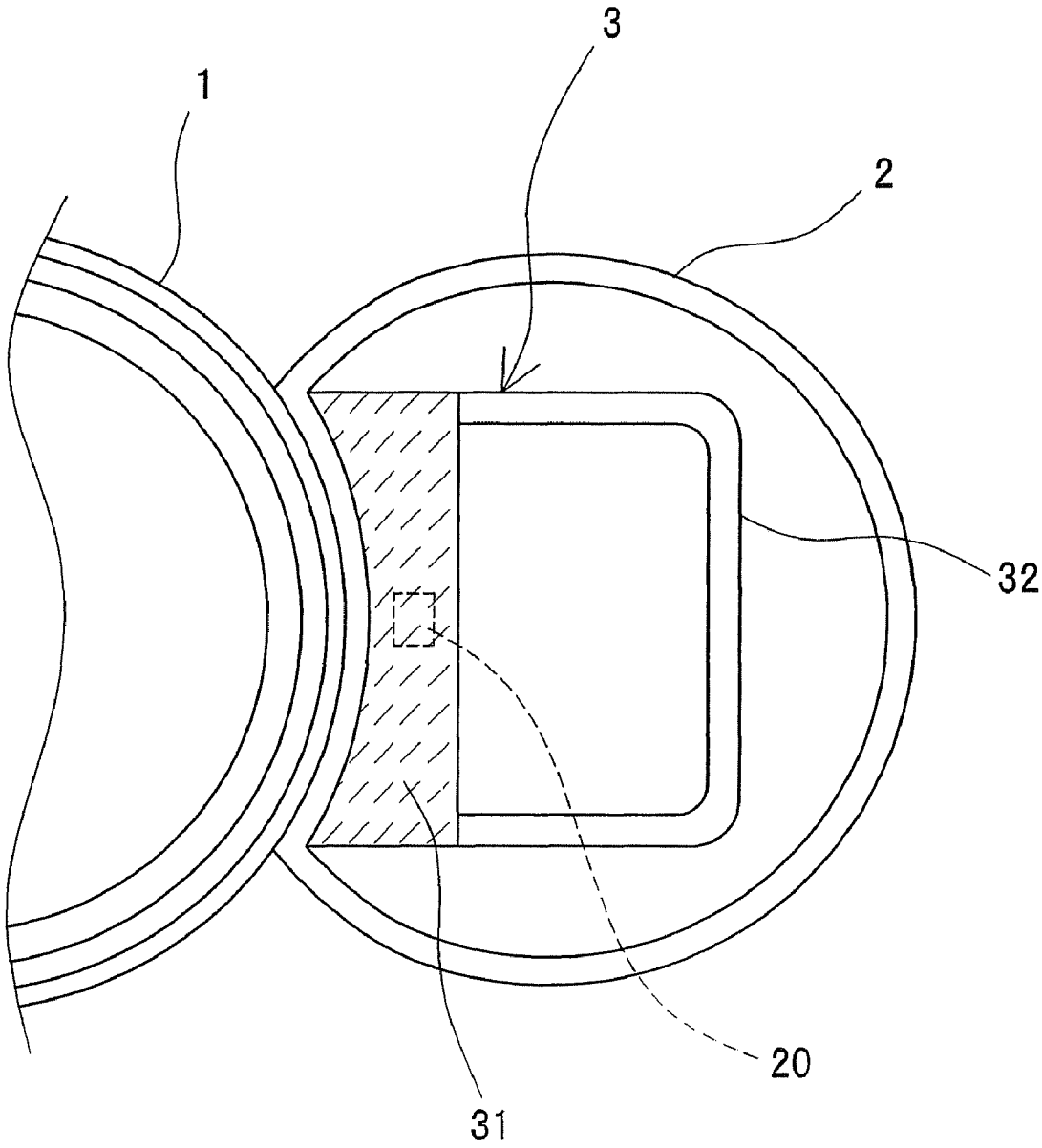
FIG. 2 is a schematic structural view showing the fixing device according to a second embodiment of the present invention.

FIG. 2 shows the fixing device according to a second embodiment of the present invention. The second embodiment differs from the first embodiment in that the pressure thermistor 20 is attached to the inside of the pad portion 31.

Therefore, it is possible to firmly attach the pressure thermistor 20 to the pad portion 31. It is possible to detect the temperature of the pressure belt 2 since the pressure thermistor 20 can be brought close to the pressure belt 2.

Third Embodiment

Figure 3:
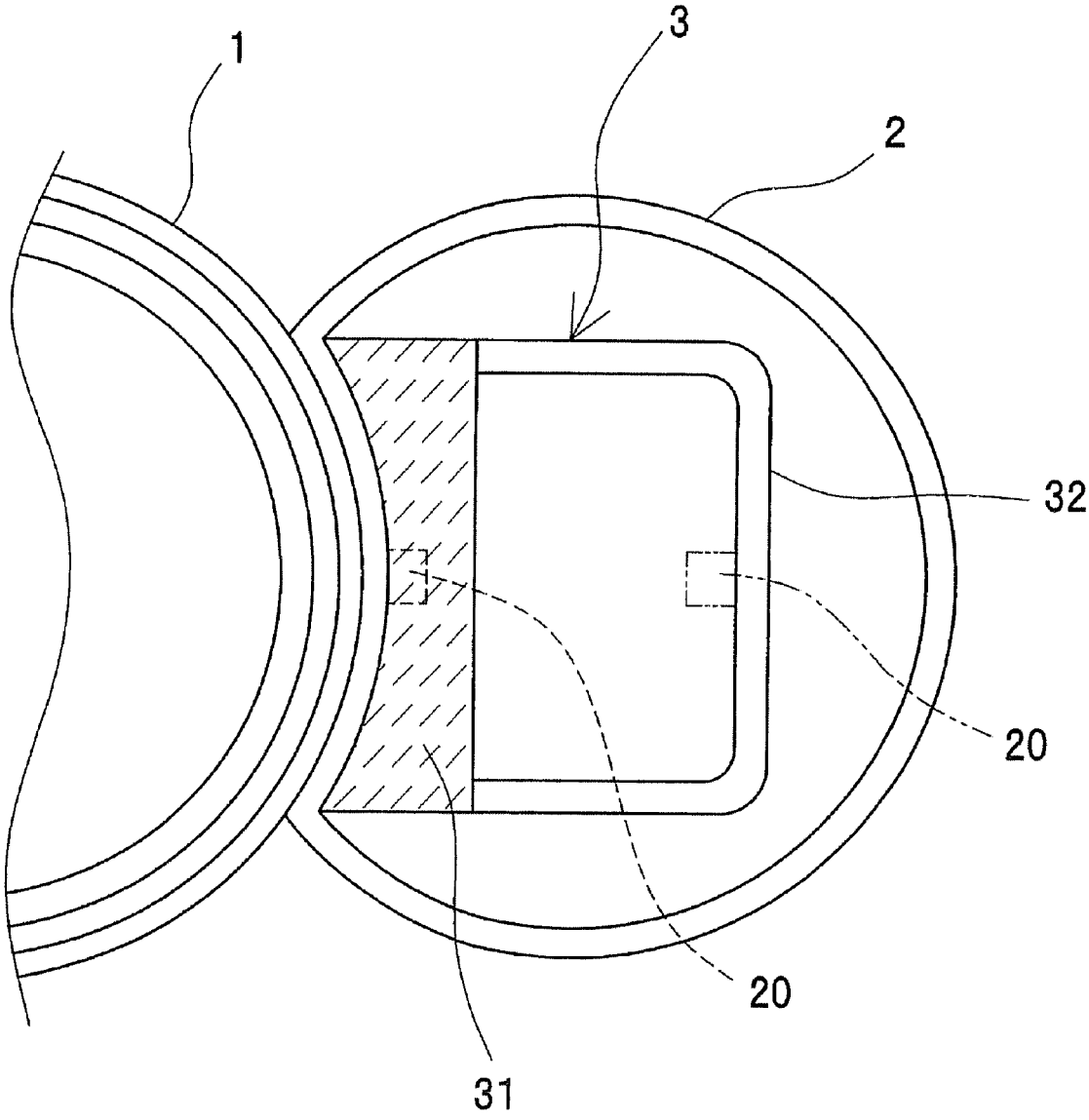
FIG. 3 is a schematic structural view showing the fixing device according to a third embodiment of the present invention.

FIG. 3 shows the fixing device according to a third embodiment of the present invention. The third embodiment differs from the first embodiment in that the pressure thermistor 20 is attached to the inside of the pad portion 31 so as to come in contact with the pressure belt 2. It is noted that the pressure thermistor 20 may be attached to the reinforcing portion 32 as indicated by an imaginary line.

Fourth Embodiment

Figure 4:
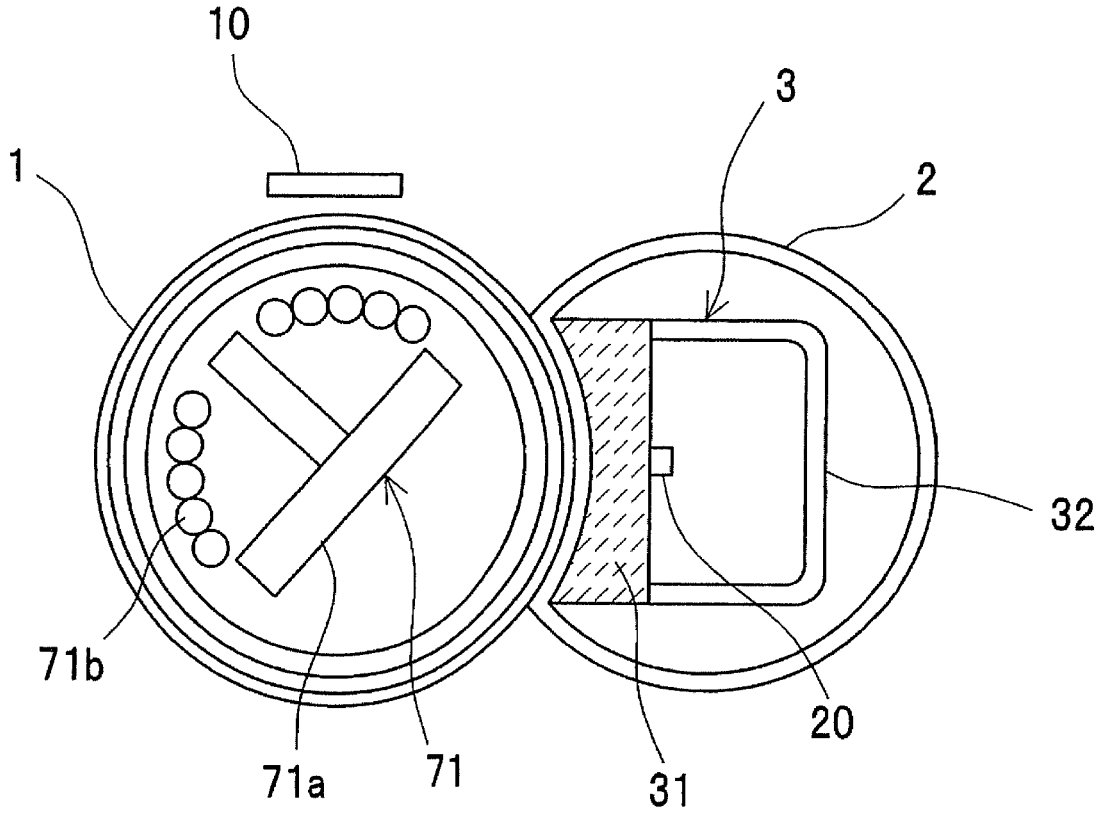
FIG. 4 is a schematic structural view showing the fixing device according to a fourth embodiment of the present invention.

FIG. 4 shows the fixing device according to a fourth embodiment of the present invention. The fourth embodiment differs from the first embodiment in that an electromagnetic induction heating unit 71 is employed as a heating section for heating the heating roller 1 in place of the heater 11.

The electromagnetic induction heating unit 71 has a core 71*a* and a coil 71*b* and is placed inside the heating roller 1. The electromagnetic induction heating unit 71 heats the heating roller 1 with electromagnetic induction by generating a magnetic flux from inside the heating roller 1.

Then, the control section 4 (see FIG. 1) controls the temperature of the electromagnetic induction heating unit 71 by adjusting the amount of power supply to the coil 71*b* on the basis of the detection temperature of the heating thermistor 10 and the detection temperature of the pressure thermistor 20.

Fifth Embodiment

Figure 5:
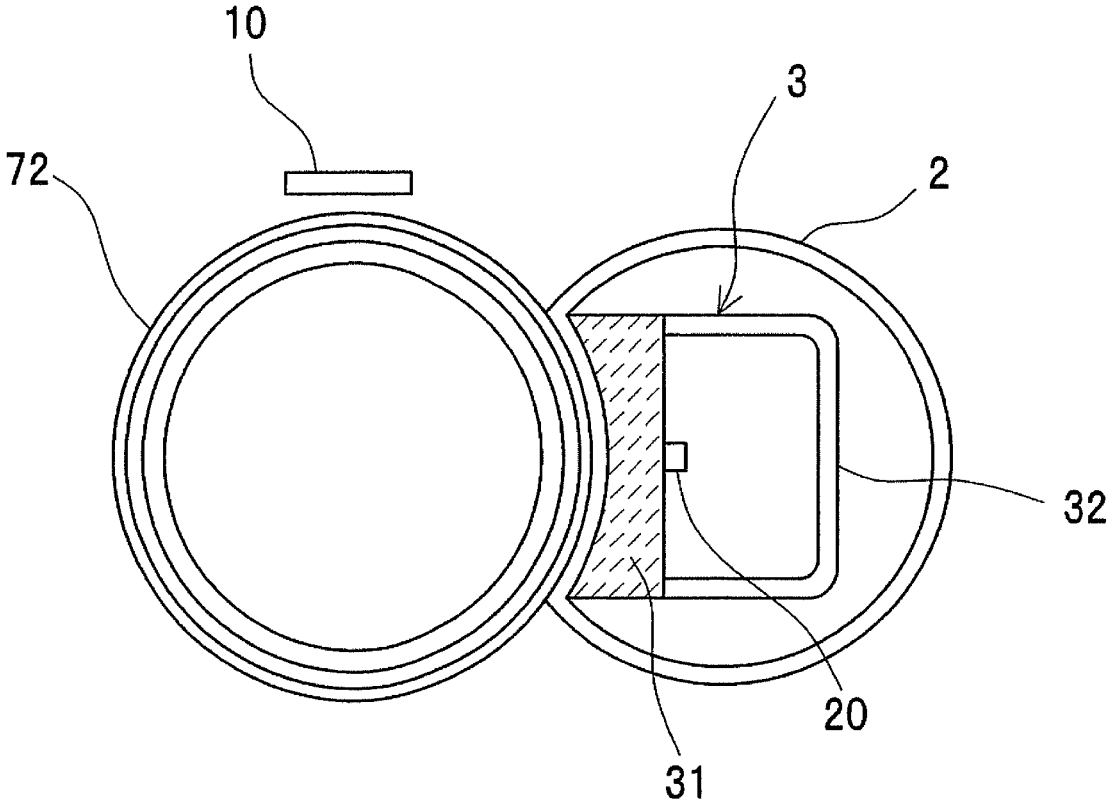
FIG. 5 is a schematic structural view showing the fixing device according to a fifth embodiment of the present invention.

FIG. 5 shows the fixing device according to a fifth embodiment of the present invention. The fifth embodiment differs from the first embodiment in that a resistance heating roller 72 concurrently serving as the heating roller 1 and the heater 11 is employed.

Then, the control section 4 (see FIG. 1) controls the temperature of the resistance heating roller 72 by adjusting the amount of power supply to the resistance heating roller 72 on the basis of the detection temperature of the heating thermistor 10 and the detection temperature of the pressure thermistor 20.

Sixth Embodiment

Figure 6:
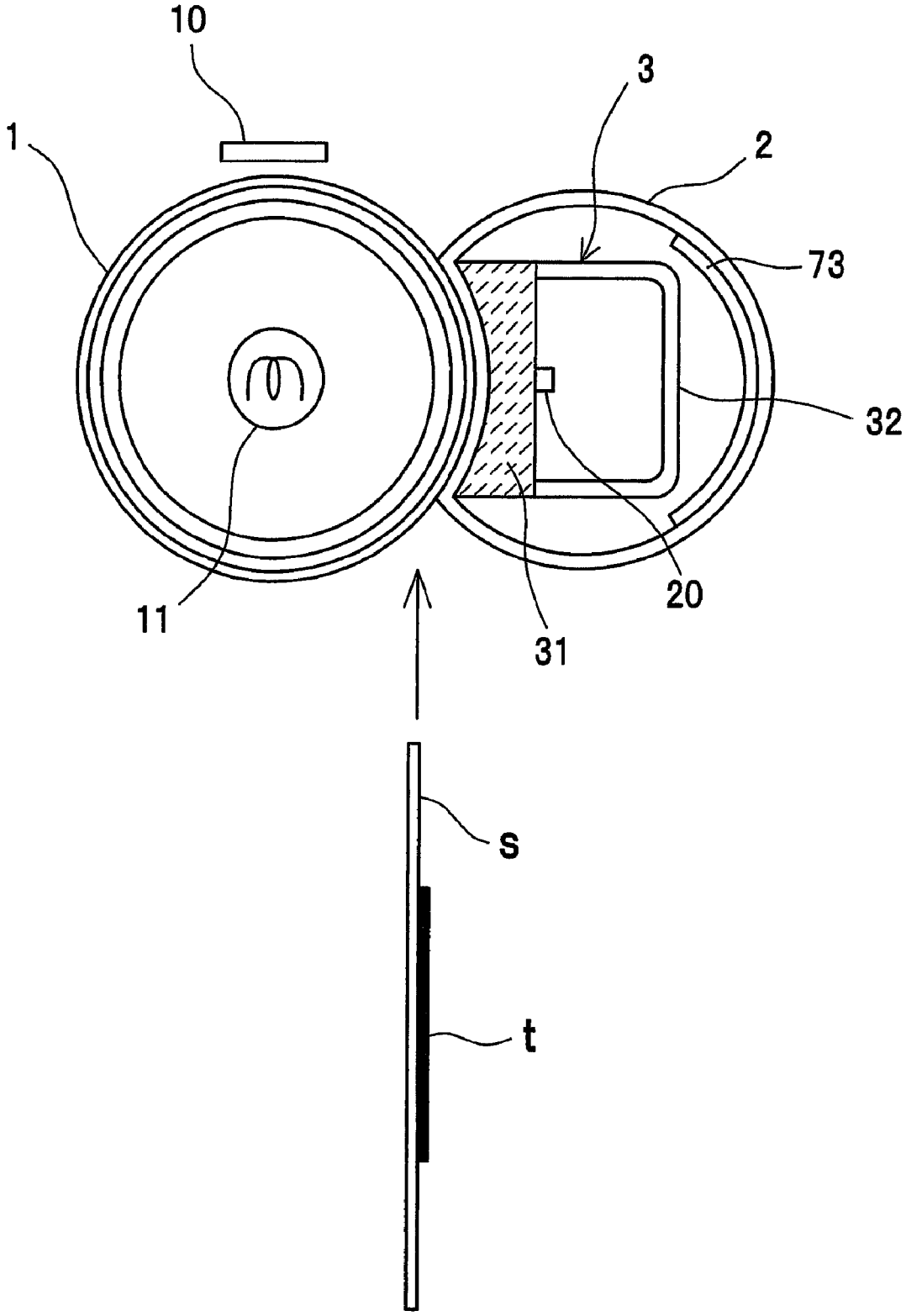
FIG. 6 is a schematic structural view showing the fixing device according to a sixth embodiment of the present invention.

FIG. 6 shows the fixing device according to a sixth embodiment of the present invention. The sixth embodiment differs from the first embodiment in that the pressure belt 2 is a fixing roller brought in contact with the image surface of the recording material S to which the toner t adheres.

A sheet-shaped heater 73 is provided inside the pressure belt 2, and the heater 73 heats the pressure belt 2.

Then, the control section 4 (see FIG. 1) controls the temperature of the heater 11 on the basis of the detection temperature of the heating thermistor 10 and the detection temperature of the pressure thermistor 20. It is noted that the control section 4 may control the temperature of the sheet-shaped heater 73 in addition to the temperature of the heater 11.

Seventh Embodiment

Figure 7:
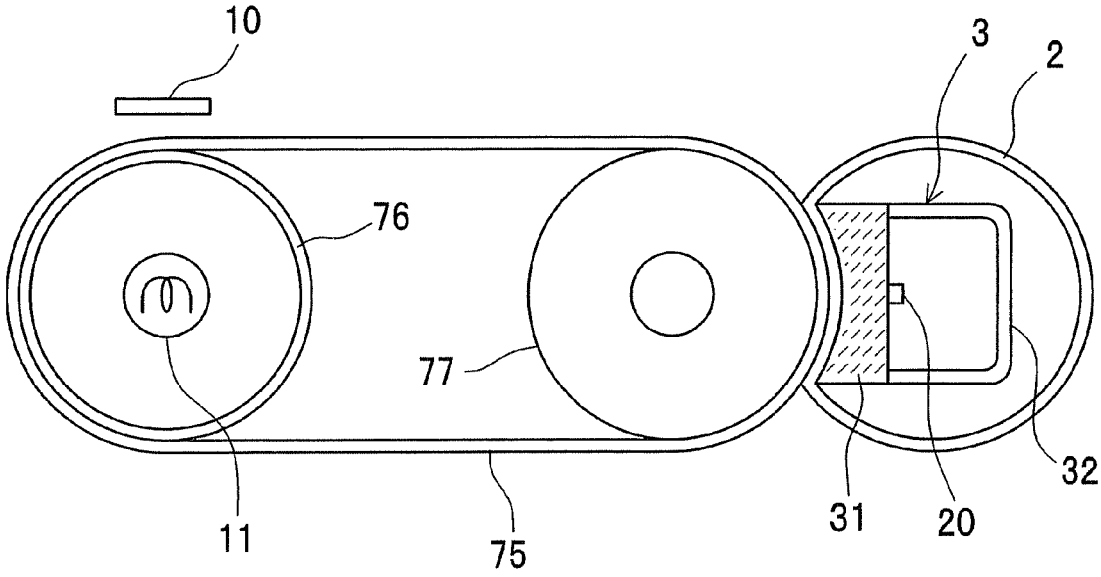
FIG. 7 is a schematic structural view showing the fixing device according to a seventh embodiment of the present invention.

FIG. 7 shows the fixing device according to a seventh embodiment of the present invention. The seventh embodiment differs from the first embodiment in that a heating belt 75 is employed as the heating rotation unit in place of the heating roller 1.

The heating belt 75 is wound around a first roller 76 and a second roller 77. The heater 11 is placed inside the first roller 76. The second roller 77 faces the pressure belt 2.

At least one of the first roller 76 and the second roller 77 is rotated. Thereby, the heating belt 75 is driven to rotate and receives heat from the heater 11 via the first roller 76. Then, fixing is performed by using the nip portion which is formed by the contact of the heating belt 75 with the pressure belt 2.

Then, the control section 4 (see FIG. 1) controls the temperature of the heater 11 on the basis of the detection temperature of the heating thermistor 10 and the detection temperature of the pressure thermistor 20.

Eighth Embodiment

In another embodiment of the fixing device temperature control method of the present invention, referring to FIG. 1, the control section 4 controls the temperature of the heater 11 by using at least the detection temperature of the heating thermistor 10 and the detection temperature of the pressure thermistor 20 as inputs and using the setting temperature of the heater 11 as an output. Thus, the temperature of the heater 11 can stably be controlled.

The relation between the detection temperature of the pressure thermistor 20 and the setting temperature of the heater 11 is shown in the following Table 2, for example.

TABLE 2

| Detection Temperature [° C.] of Pressure Thermistor | Setting Temperature [° C.] |
|---|---|
| 20-30 | 119 |
| 30-50 | 127 |
| 50-70 | 136 |
| 70-90 | 146 |
| 90-110 | 158 |

Ninth Embodiment

In yet another embodiment of the fixing device temperature control method of the present invention, referring to FIG. 1, the control section 4 controls the temperature of the heater 11 by using at least the detection temperature of the heating thermistor 10 and the detection temperature of the pressure thermistor 20 as inputs and using the amount of power supply to the heater 11 and the setting temperature of the heater 11 as outputs. Thus, the temperature of the heater 11 can stably be controlled.

Tenth Embodiment

In still another embodiment of the fixing device temperature control method of the present invention, referring to FIG. 1, a first corrected temperature T1' is obtained by multiplying a detection temperature T of the heating thermistor 10 by a first correction factor R1. A second corrected temperature T2' is obtained by multiplying the first corrected temperature T1' by an optimal second correction factor R2 which is obtained on the basis of a detection temperature of the pressure thermistor 20. The control section 4 controls the temperature of the heater 11 by using the second corrected temperature T2' as an input.

Specifically, an ideal value of the first correction factor R1 is preparatorily obtained through an experiment. That is, the ideal value is obtained by using the temperature of the heating roller 1 and the detection temperature T of the heating thermistor 10 according to the following equation:

$$\text{Ideal First Correction Factor } R1 = \text{Heating Roller Temperature}/\text{Detection Temperature } T \quad (1)$$

The control section 4 performs the control with use of multiplication of the detection temperature T, which is consistently detected by the heating thermistor 10, by the ideal first correction factor R1. The value of the ideal first correction factor R1 is varied by the placement distance of the heating thermistor 10 to the heating roller 1 and by the environment in which the image forming apparatus is placed. The control section 4 specifies the value of the ideal first correction factor R1 with respect to the placement distance and the environmental variation. The variation in the value of the ideal first correction factor R1 and the like are shown in the graphs of FIGS. 8 and 9.

Figure 8:
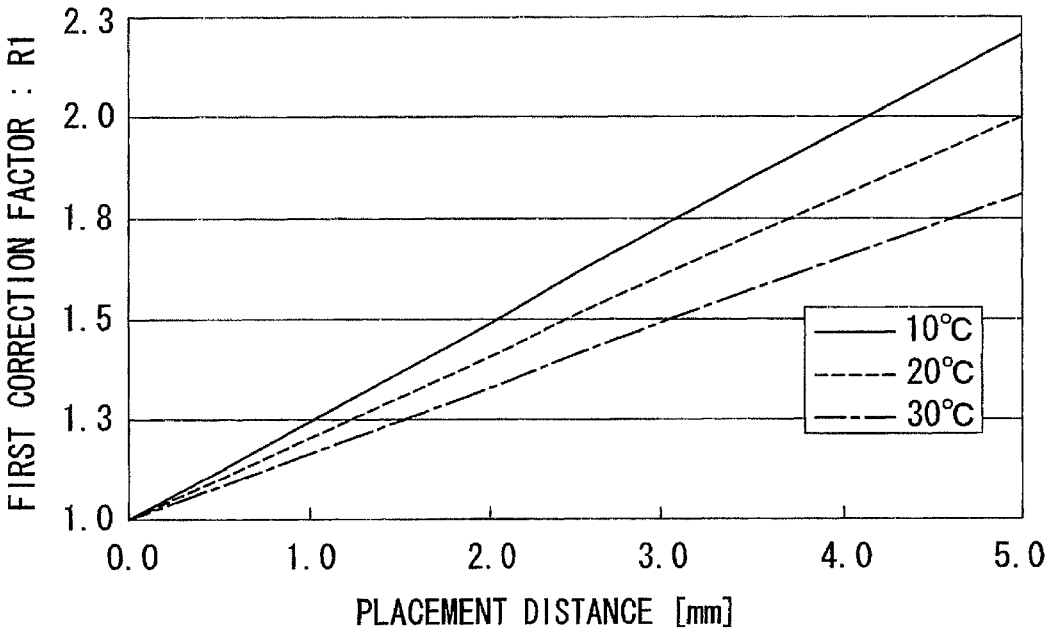
FIG. 8 is a graph showing relation of a first correction factor to a distance between a heating thermistor and a heating roller when the temperature of an intra-device temperature sensor is assumed as a system.

Specifically, FIG. 8 shows a graph for obtaining the ideal first correction factor R1 under Equation (1), where the fixing device is placed in a managed environmental space. It can be seen that there is an ideal first correction factor R1 with regard to a placement distance and an environmental temperature.

Figure 9:
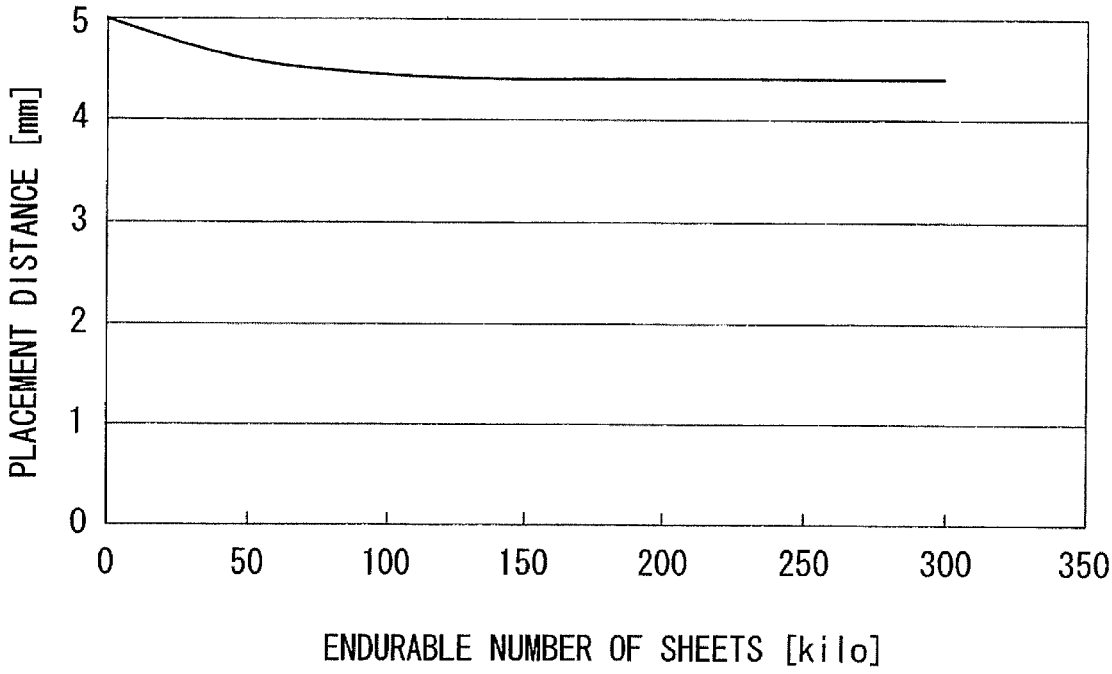
FIG. 9 is a graph showing relation of endurable number of sheets to a distance between the heating thermistor and the heating roller.

On the other hand, FIG. 9 shows a graph of the variation in the placement distance of the heating thermistor 10 to the heating roller 1 when the outside diameter of the heating roller 1 is varied by endurance factor. The outside diameter of the heating roller 1 is varied by the endurance factor, and thereby the placement distance is varied.

The environmental temperature is determined by using a detection temperature of, for example, an intra-device temperature sensor attached to the image forming apparatus. The control may be performed by changing the first correction factor R1 on each of occasions when the detection temperature of the intra-device temperature sensor is lower than 15° C., when it is not lower than 15° C. and lower than 25° C., and when it is not lower than 25° C., for example.

In the case where the placement distance of the heating thermistor 10 to the heating roller 1 is preparatorily set to 5.0 mm for example, the control section 4 sets the first correction factor R1 to 2.2 when the detection temperature of the intra-device temperature sensor is lower than 15° C., the control section 4 sets the first correction factor R1 to 2.0 when the detection temperature of the intra-device temperature sensor is not lower than 15° C. and lower than 25° C., and the control section 4 sets the first correction factor R1 to 1.8 when the detection temperature of the intra-device temperature sensor is not lower than 25° C. The first corrected temperature T1' is obtained with use of multiplication of the detection temperature T of the heating thermistor 10 by the first correction factor R1. The graph of FIG. 8 may be represented in a table or mathematization.

The control section 4 has a table of the graph shown in FIG. 9 or mathematization thereof for example. Therefore, the placement distance of the heating thermistor 10 to the heating roller 1 is obtained by using the endurable number of sheets as an input.

Then, the control section 4 obtains an appropriate first correction factor R1 by using the placement distance obtained hereinabove as an input to tabularization or mathematization of the graph shown in FIG. 8. At this time, an endurance time may be used instead of the endurable number of sheets. Otherwise, it should be used at least one factor of the endurable number of sheets or the endurance time and the environmental temperature. It is acceptable to use two or more of those factors as inputs.

Although the temperature of the intra-device temperature sensor has been taken as an example for the environmental temperature, it is also acceptable to use a temperature of the fixing device, a neighboring temperature of the thermistor, a periphery temperature of the image forming apparatus or the like.

Although, as an example, the outside diameter of the heating roller 1 is varied by endurance, it is considered that the ideal first correction factor R1 may also be varied by endurance due to a phenomenon such as dirt. As in the case of the above, however, the ideal first correction factor R1 can be similarly set to an ideal value. Further, the correction factor may be appropriately changed according to the device.

Then, a second corrected temperature T2' is obtained by multiplying the first corrected temperature T1' of the heating thermistor 10 by a second correction factor R2, wherein the first corrected temperature T1' is obtained as described above and wherein the second correction factor R2 changes according to the detection temperature of the pressure thermistor 20.

The relation between the detection temperature of the pressure thermistor 20 and the second correction factor R2 is shown in the following Table 3, for example.

TABLE 3

| Detection Temperature [° C.] of Pressure Thermistor | Second Correction Factor R2 |
|---|---|
| 20-30 | 1.00 |
| 30-50 | 0.94 |
| 50-70 | 0.88 |
| 70-90 | 0.81 |
| 90-110 | 0.75 |

Then, the control section 4 controls the temperature of the heater 11 by using the second corrected temperature T2' as an input and using, for example, the amount of power supply to the heater 11 and the setting temperature of the heater 11 as outputs.

Eleventh Embodiment

Figure 10:
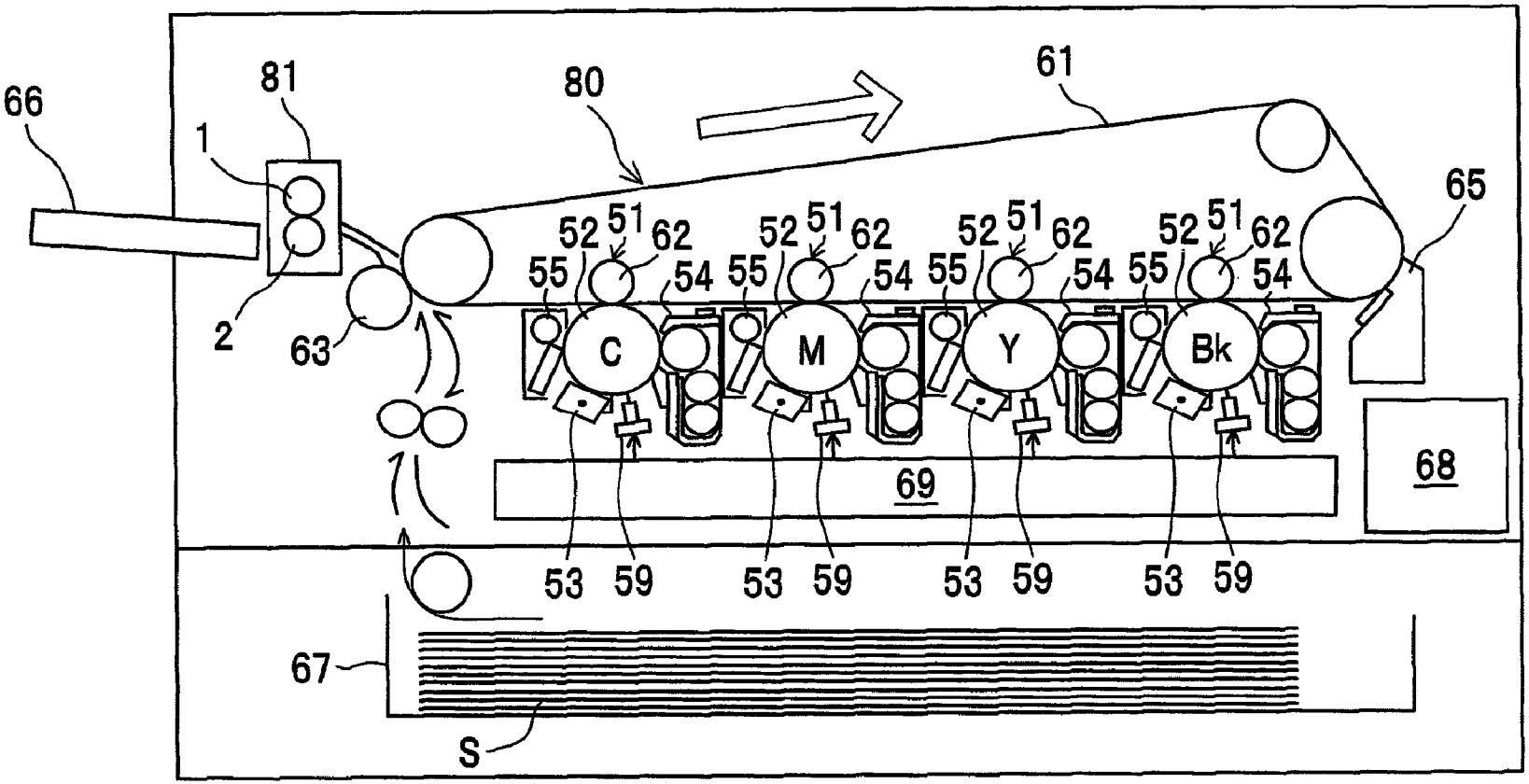
FIG. 10 is a schematic structural view showing an image forming apparatus of the present invention.

FIG. 10 shows a schematic structural view of the image forming apparatus according to an embodiment of the present invention. The image forming apparatus has an imaging device 80 and the fixing device 81 of the first embodiment, wherein the imaging device 80 forms an image by making unfixed toner t adhere to the recording material S, and the fixing device 81 fuses and fixes the toner t on the recording material S. The image forming apparatus is an electrophotographic four-color printer.

The imaging device 80 has an intermediate transfer belt 61, four image forming units 51 that are arranged along the intermediate transfer belt 61 and form toner images, primary transfer sections 62 that transfer the toner images formed by the image forming units 51 onto the intermediate transfer belt 61, and a secondary transfer section 63 that transfers the image, which has been transferred to the intermediate transfer belt 61, onto the recording material S.

The image forming unit 51 that forms a black (BK) toner image, the image forming unit 51 that forms a yellow (Y) toner image, the image forming unit 51 that forms a magenta (M) toner image, and the image forming unit 51 that forms a cyan (C) toner image are arranged in order from the upstream to the downstream of the intermediate transfer belt 61.

Each of the image forming units 51 includes a photoreceptor drum 52, a charging section 53 for uniformly electrically charging the photoreceptor drum 52, an exposure section 59 for exposure of an image on the charged photoreceptor drum 52, and a developing section 54 for developing an electrostatic latent image formed through the exposure with toners of respective colors.

The image forming apparatus has a controller 68 that controls the whole image forming apparatus and has an exposure controller 69 to which the signal corresponding to the image is sent from the controller 68. The exposure controller 69 drives each of the exposure sections 59 according to the respective colors.

Operation of the image forming apparatus is described next.

The toner images developed on the photoreceptor drums 52 of the image forming units 51 are primarily transferred onto the intermediate transfer belt 61 by the transfer sections 62 along a contact position with the intermediate transfer belt 61.

The toner images transferred onto the intermediate transfer belt 61 have the respective colors superposed on every occasion when the intermediate transfer belt 61 passes through the image forming units 51. Finally, a full-color toner image is formed on the intermediate transfer belt 61.

Subsequently, the full-color toner image on the intermediate transfer belt 61 is secondarily transferred onto the recording material S collectively by the secondary transfer section 63 on the downstream side of the intermediate transfer belt 61.

Then, the toner images on the recording material S are fixed when the recording material S passes through the fixing device 81 located on the downstream side of the conveyance path of the recording material S. Then the recording material S is discharged onto a paper discharge tray 66.

The recording material S is stored within a cassette 67 located in a lowermost part of the image forming apparatus. The recording material S is conveyed one by one from the cassette 67 to the secondary transfer section 63.

After the primary transfer, the toner remaining on the photoreceptor drum 52 is removed by a cleaning section 55 placed on the downstream side, and then the toner is collected from the lower side of the cleaning section 55.

Moreover, after the secondary transfer, the toner remaining on the intermediate transfer belt 61 is removed from on the intermediate transfer belt 61 by a cleaning blade 65, conveyed by a conveyance screw (not shown) and collected into a waste toner container (not shown).

According to the image forming apparatus having the above-stated construction, it is possible to obtain a stable fixed image performance since the fixing device 81 is provided. The fixing device described in any one of the second through seventh embodiments (FIGS. 2 through 7) may be used as the fixing device of the present image forming apparatus. Also, the fixing device temperature control method described in any one of the first and eighth through tenth embodiments may be used as a method for controlling the fixing device of the present image forming apparatus.

It should be noted that the present invention is limited to none of the embodiments described above. For example, a roller may be used as the pressurizing rotation unit besides the pressure belt 2. Also, a thermocouple may be used for the first and second temperature detecting sections besides the heating thermistor 10 or the pressure thermistor 20.

The pressure thermistor 20 may be noncontact with respect to the pressurizing unit 3. In addition, the first correction factor R1 of the tenth embodiment may be applied to the correction factor R of the first embodiment.

The fixing device temperature control method described in any one of the first embodiment and the eighth through tenth embodiments may be used for the fixing device of the first through seventh embodiments (FIGS. 1 through 7).

Moreover, the image forming apparatus may be any one of a monochrome/color copying machine, a printer, a FAX and a composite machine of these.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A fixing device temperature control method comprising the steps of:

detecting a surface temperature of a heating rotation unit in a position located apart from a surface of the heating rotation unit by using a noncontact first temperature detecting section;

detecting a temperature of a pressurizing unit, which is placed inside a pressurizing rotation unit and pressurizes the pressurizing rotation unit against the heating rotation unit from inside of the pressurizing rotation unit, by using a second temperature detecting section; and adjusting a surface temperature of the heating rotation unit by controlling a heating section which heats the heating rotation unit with use of a control section on the basis of a detection temperature of the first temperature detecting section and a detection temperature of the second temperature detecting section, wherein a first corrected temperature is obtained by multiplying the detection temperature of the first temperature detecting section by a first correction factor, a second corrected temperature is obtained by multiplying the first corrected temperature by an optimal second correction factor obtained on the basis of the detection temperature of the second temperature detecting section, and the control section controls the heating section by using the second corrected temperature as an input.

2. The fixing device temperature control method as claimed in claim 1, wherein the first correction factor is obtained on the basis of at least one of a placement distance of the temperature detecting section to the heating rotation unit, an endurable number of sheets, an endurance time and an environmental temperature.

3. A fixing device comprising:

a heating rotation unit and a pressurizing rotation unit which convey a recording material in mutual contact while fixing a toner on the recording material;

a heating section which heats the heating rotation unit;

a noncontact first temperature detecting section which detects a surface temperature of the heating rotation unit in a position located apart from a surface of the heating rotation unit;

a pressurizing unit which is placed inside the pressurizing rotation unit and pressurizes the pressurizing rotation unit against the heating rotation unit from inside the pressurizing rotation unit;

a second temperature detecting section which detects a temperature of the pressurizing unit; and a control section which obtains a corrected temperature of the heating rotation unit on the basis of detection temperatures of both the first and second temperature detecting sections and adjusts the surface temperature of the heating rotation unit so as to be the corrected temperature by controlling the heating section.

4. An image forming apparatus comprising:

an imaging device which forms an image by making an unfixed toner adhere to a recording material; and the fixing device claimed in claim 3, which fuses and fixes the toner on the recording material.

5. The fixing device as claimed in claim 3, wherein the control section obtains an optimal correction factor on the basis of the detection temperature of the second temperature detecting section, and the control section obtains the corrected temperature of the heating rotation unit on the basis of the optimal correction factor and the detection temperature of the first temperature detecting section.

6. The fixing device as claimed in claim 3, wherein the second temperature detecting section is attached to a surface of the pressurizing unit.

7. The fixing device as claimed in claim 3, wherein the second temperature detecting section is attached to inside of the pressurizing unit.

8. The fixing device as claimed in claim 3, wherein the heating section which heats the pressurizing rotation unit is not provided inside the pressurizing rotation unit.

9. The fixing device as claimed in claim 3, wherein the heating rotation unit is a hollow roller, and the pressurizing rotation unit is an endless belt.

10. A fixing device temperature control method comprising the steps of:

detecting a surface temperature of a heating rotation unit in a position located apart from a surface of the heating rotation unit by using a noncontact first temperature detecting section;

detecting a temperature of a pressurizing unit, which is placed inside a pressurizing rotation unit and pressurizes the pressurizing rotation unit against the heating rotation unit from inside of the pressurizing rotation unit, by using a second temperature detecting section; and obtaining a corrected temperature of the heating rotation unit on the basis of detection temperatures of both the first and second temperature detecting sections and adjusting a surface temperature of the heating rotation unit so as to be the corrected temperature by controlling a heating section which heats the heating rotation unit with use of a control section.

11. The fixing device temperature control method as claimed in claim 10, wherein the control section obtains an optimal correction factor on the basis of the detection temperature of the second temperature detecting section, and the control section obtains the corrected temperature of the heating rotation unit on the basis of the optimal correction factor and the detection temperature of the first temperature detecting section and controls the heating section on the basis of the corrected temperature.

12. The fixing device temperature control method as claimed in claim 10, wherein the control section controls the heating section by using at least the detection temperature of the first temperature detecting section and the detection temperature of the second temperature detecting section as inputs and by using the amount of power supply to the heating section as an output.

13. The fixing device temperature control method as claimed in claim 10, wherein the control section controls the heating section by using at least the detection temperature of the first temperature detecting section and the detection temperature of the second temperature detecting section as inputs and by using a setting temperature of the heating section as an output.

14. The fixing device temperature control method as claimed in claim 10, wherein the control section controls the heating section by using at least the detection temperature of the first temperature detecting section and the detection temperature of the second temperature detecting section as inputs and by using the amount of power supply to the heating section and a setting temperature of the heating section as outputs.

15. The fixing device temperature control method as claimed in claim 10, wherein the corrected temperature is obtained by multiplying the detection temperature of the first temperature detecting section by an optimal correction factor obtained on the basis of the detection temperature of the second temperature detecting section, and the control section controls the heating section by using the corrected temperature as an input.

* * * * *